US007226405B2

(12) United States Patent
Letherer

(10) Patent No.: US 7,226,405 B2
(45) Date of Patent: Jun. 5, 2007

(54) METHODS AND APPARATUS FOR FORMING A REVERSE KISS CUT AND SCORE LINE IN A SHEET OF DEFORMABLE MATERIAL

(75) Inventor: Todd R. Letherer, Lawrenceburg, TN (US)

(73) Assignee: Graphic Packaging International, Inc., Marietta, GA (US)

( * ) Notice: Subject to any disclaimer, the term of this patent is extended or adjusted under 35 U.S.C. 154(b) by 18 days.

(21) Appl. No.: 11/034,030

(22) Filed: Jan. 12, 2005

(65) Prior Publication Data

US 2005/0164860 A1 Jul. 28, 2005

Related U.S. Application Data

(60) Provisional application No. 60/536,138, filed on Jan. 12, 2004.

(51) Int. Cl.
*B31B 1/25* (2006.01)

(52) U.S. Cl. ..... 493/160; 493/143; 493/59; 83/175; 83/879; 83/881

(58) Field of Classification Search ..... 493/59–61, 493/68, 69, 160, 167, 174, 175, 143; 83/175, 83/176, 879, 881
See application file for complete search history.

(56) References Cited

U.S. PATENT DOCUMENTS

| | | | | |
|---|---|---|---|---|
| 3,526,566 | A * | 9/1970 | McIlvain, Jr. et al. | 428/121 |
| 3,570,337 | A | 3/1971 | Morgan | |
| 3,664,543 | A * | 5/1972 | Brown et al. | 220/270 |
| 3,907,193 | A | 9/1975 | Heller | |
| 4,348,464 | A * | 9/1982 | Khoury | 428/571 |
| 4,513,873 | A * | 4/1985 | Klaschka | 220/89.2 |
| 4,987,520 | A * | 1/1991 | Rots | 361/521 |
| 5,298,010 | A * | 3/1994 | Levine | 493/354 |
| 5,470,016 | A | 11/1995 | Ljungström et al. | |
| 5,797,543 | A * | 8/1998 | Spronk et al. | 229/116.1 |
| 2005/0064652 | A1 * | 3/2005 | Shapira | 438/232 |

FOREIGN PATENT DOCUMENTS

| | | |
|---|---|---|
| DE | 196 08 690 A1 | 10/1997 |
| FR | 457 066 | 9/1913 |
| FR | 462 126 | 1/1914 |
| GB | 977 069 | 12/1964 |

OTHER PUBLICATIONS

Declaration Regarding Prior Art executed by Todd R. Letherer dated Oct. 3, 2005.

* cited by examiner

*Primary Examiner*—Hemant M. Desai
(74) *Attorney, Agent, or Firm*—Womble Carlyle Sandridge & Rice, PLLC

(57) ABSTRACT

Methods and apparatus for forming a score line with a reverse kiss cut in a deformable material are provided. A method can include providing two plates, such as a die plate with a scoring rule thereon and a counter plate with an aligned corresponding recess with a knife edge positioned therein and protruding toward the scoring rule. When the die plate is advanced toward the counter plate, the deformable material is forced into the recess of the counter plate to form the score line and the knife simultaneously forms a cut or slit in the bottom surface of the deformable material to form a reverse kiss cut.

30 Claims, 6 Drawing Sheets

METHODS AND APPARATUS FOR FORMING A REVERSE KISS CUT AND SCORE LINE IN A SHEET OF DEFORMABLE MATERIAL

CROSS-REFERENCE TO RELATED APPLICATION

The present application claims the benefit of U.S. Provisional Application No. 60/536,138, filed Jan. 12, 2004, and entitled METHOD OF FORMING A REVERSE KISS CUT AND A SCORE LINE IN A SHEET OF DEFORMABLE MATERIAL, and the above-referenced provisional application is incorporated herein by reference.

FIELD OF THE INVENTION

The present invention relates generally to methods of pre-conditioning deformable materials such as paperboard products to establish readily foldable lines to allow the material to be folded into three-dimensional configurations to form containers.

BACKGROUND

Cardboard containers and the like typically are formed from flat blanks of deformable paperboard materials. Before forming the container, the flat blanks of material are preconditioned with score lines, perforated lines and/or the like, which assist or readily enable the blank of material to be folded into a predetermined three dimensional configuration. Cardboard containers for numerous products including foods, beverages, pharmaceuticals and the like are formed in this manner.

In order to facilitate tearing, removal or separation of the material along predetermined lines, tear lines are established in the blank by perforating the material. The blank can also have score lines formed therein. Generally described, a score line is an indentation in one surface of the material, which typically, but not necessarily, causes a corresponding protuberance from the opposite surface of the material. Score lines are utilized to precondition the blank material for folding and typically are created with a die set, which generally includes a die plate and a counter plate. The die plate generally has a scoring rule or protrusion formed therein, while the counter plate generally has a recess complimenting the scoring rule on the die plate. The deformable material being treated is positioned between the die plate and the counter plate so that when the die plate is advanced against the counter plate under pressure, the material is deformed creating a recess in one surface, corresponding to the scoring rule, and a protrusion in the opposite surface, corresponding to the recess in the counter plate. The material is readily folded in the direction of the recess created therein to allow easy configuration of a container from the deformable blank of material.

In order to more easily fold along score lines, it is conventional to form at least one elongate cut in the protrusion that has previously been formed in the blank material, with the cut being formed in the side of the blank material having the protrusion. Cutting operations such as these are commonly used in gusseted corners of containers, for facilitating easier folding inwardly. These gusseted corners are generally formed at adjacent folded walls of the container.

It is conventional for the score and associated cut to be formed in a multi-step process. First, the score is formed with the die plate and counter plate and, in a subsequent step that occurs after there being relative movement for alignment purposes, a knife is used to the form the cut. The cut typically protrudes approximately fifty percent into the thickness of the blank material.

The conventional method for forming a reverse cut along a score line is time consuming and can be inaccurate; therefore, improvements are desired.

SUMMARY OF SOME ASPECTS OF THE PRESENT INVENTION

An aspect of the present invention relates to a process for scoring and reverse kiss cutting a blank of deformable material simultaneously to reduce the time and expense involved in preconditioning a blank of deformable material. In accordance with an aspect of the present invention, score lines and reverse kiss cuts formed in accordance with an embodiment of the present invention enable ready folding of the material, and these lines and cuts can be arranged diagonally, or otherwise, with respect to the deformable material's length.

A method of an embodiment of the present invention utilizes a conventional die plate having a scoring rule or scoring rules in predetermined patterns there along and a complimentary counter plate having a recess or recesses corresponding to the scoring rule or rules. At least one knife blade is positioned within the recesses, with the blade projecting toward the die plate a distance sufficient to establish a cut that is, in one embodiment, approximately halfway through the deformable material. The cut is formed at substantially the same time as the score line. This cut, and similar cuts of different depths, can be referred to as reverse kiss cuts.

Score lines with reverse kiss cuts can be folded more readily than conventional score lines. In one embodiment of the present invention, a score line with a reverse kiss cut has the depression of a conventional score line formed in the same surface as the other score lines in the blank material and the reverse kiss cut is made through approximately half the thickness of the material from the opposite side of the blank material along a protrusion formed on that side of the material during the scoring process.

Accordingly, in a one step process, a score line and reverse kiss cut can be formed in a deformable material to establish a fold line along which the material can be folded more readily than with a generally corresponding standard score line. The method is useful, for example, when preconditioning a sheet of deformable material such as paperboard for use in containers, and it is particularly useful in corner gussets.

Other aspects, features and details of the present invention can be more completely understood by reference to the following detailed description taken in conjunction with the drawings and from the appended claims.

DETAILED DESCRIPTION OF AN EMBODIMENT

An embodiment of the present invention is described in connection with a flat blank of deformable material that can be deformed in a manner so as to retain the deformation. An example of such a material is paperboard, with a specific example being a non-clay coated craft board laminated with a polyethylene to a film, or the like. Such a blank material can be conditioned with score lines, perforated lines, score lines with reverse kiss cuts, and the like, which allow the blank of material to be easily folded into a predetermined carton configuration.

Figure 1:
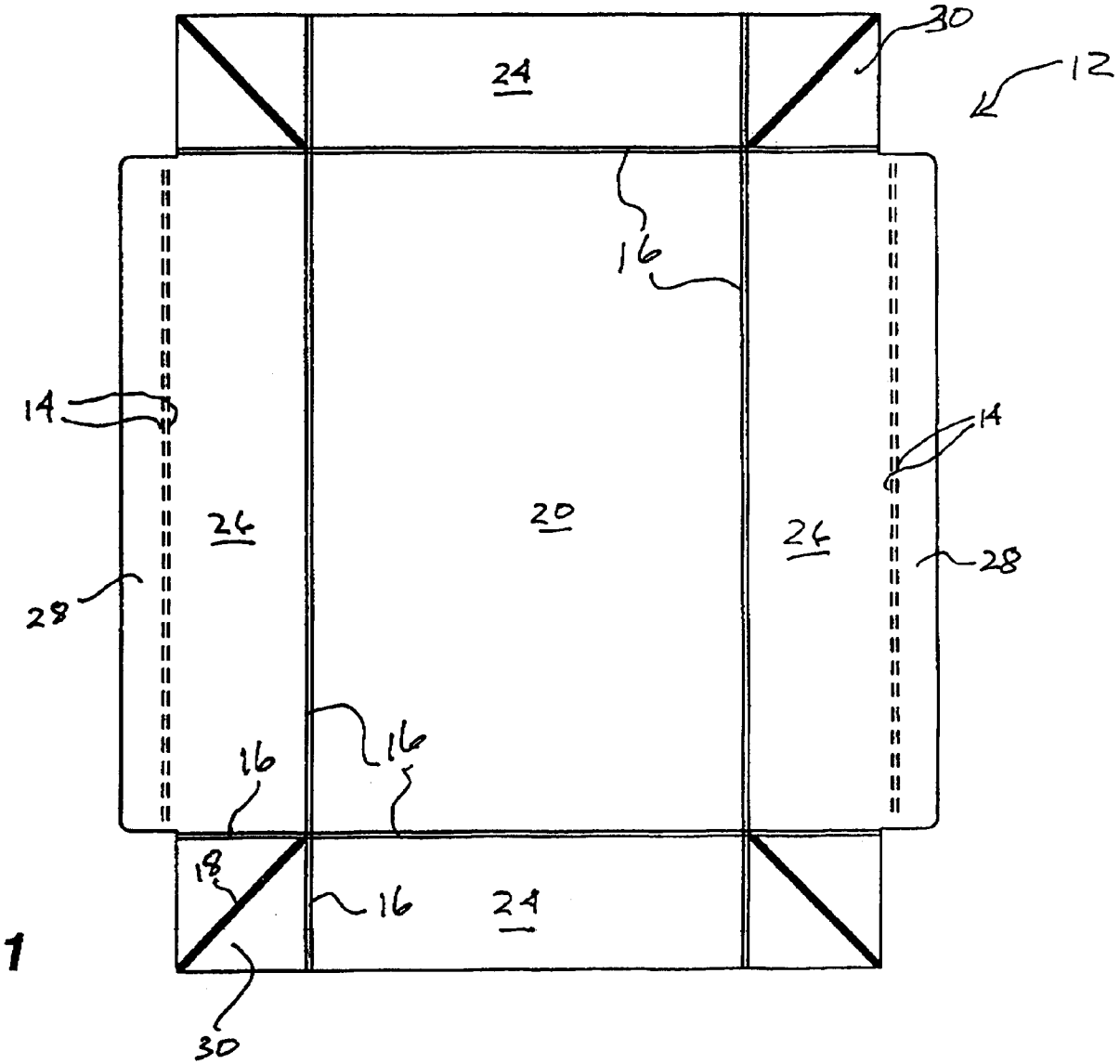
FIG. 1 is a top plan view of a flat blank of deformable material that has been preconditioned for folding, in accordance with an embodiment of the present invention.
Figure 2:
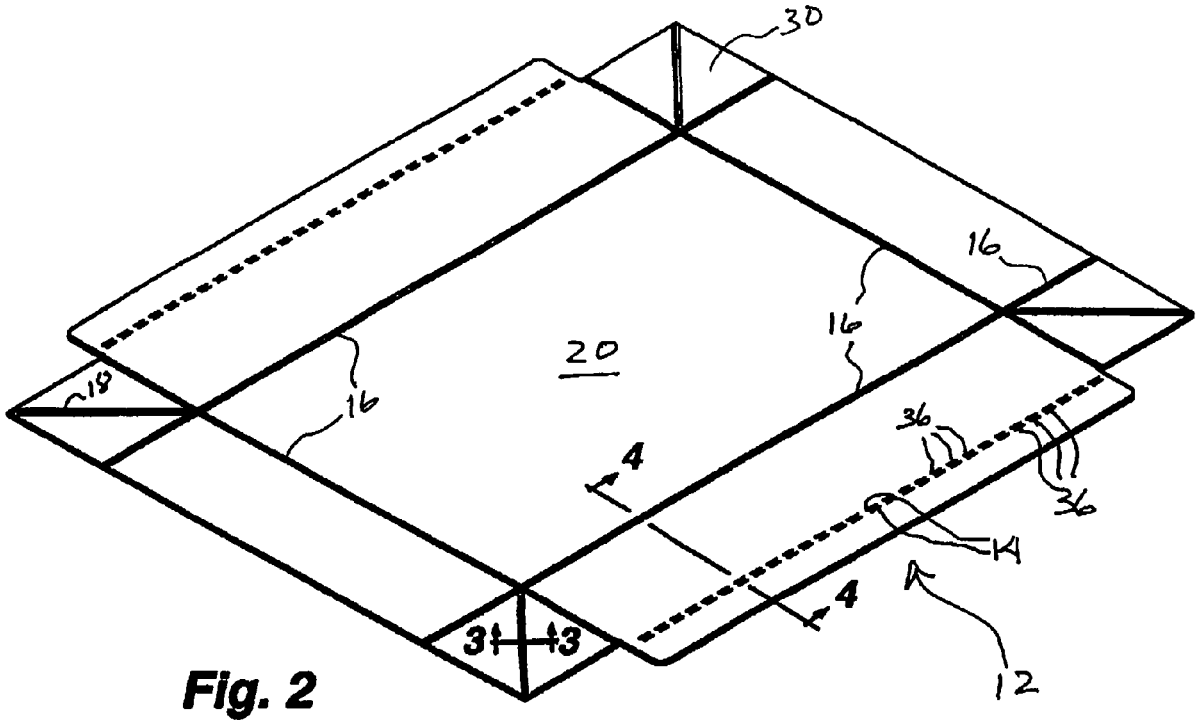
FIG. 2 is an isometric view of the top blank shown in FIG. 1.

With reference to FIGS. 1 and 2, a blank of deformable material 12 is illustrated that has been preconditioned with perforated lines 14, score lines 16, and score lines 18 with reverse kiss cuts, in accordance with an exemplary embodiment of the present invention. The blank of material has a base rectangular area 20 that defines the bottom panel of an open-topped container 22 (FIG. 7) formed from the blank of material with end panels 24 integrally formed at opposite longitudinal ends of the base and side panels 26 along opposite longitudinal sides of the base. The blank 12 and container 22 are not novel per se.

The side panels have flaps 28 defined along the outer edges thereof with the flaps being separated from the remainder of the side panels by a pair of closely spaced perforated lines 14 that are placed in the blank of material in a conventional manner. In each corner of the blank between side panels and end panels, a gusset 30 is defined in a generally square configuration with a diagonal score line 18 and a reverse kiss cut formed therein extending from the corner of the base to the opposite corner of the gusset. Conventional score lines 16 separate the base 20 from the end panels 24 and the side panels 26 and also separate the gusseted corners 30 from the end panels and side panels. These score lines 16 are formed in a conventional manner as described above. In accordance with the exemplary embodiment of the present invention, the score lines 18 with the reverse kiss cut are formed in accordance with the present method as described herein.

Figure 3:
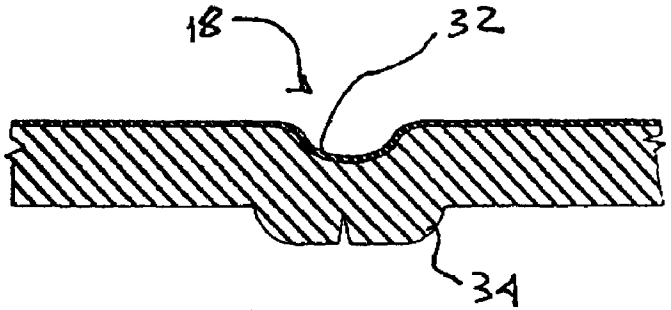
FIG. 3 is an enlarged fragmentary section taken along line 3—3 of FIG. 2.
Figure 4:
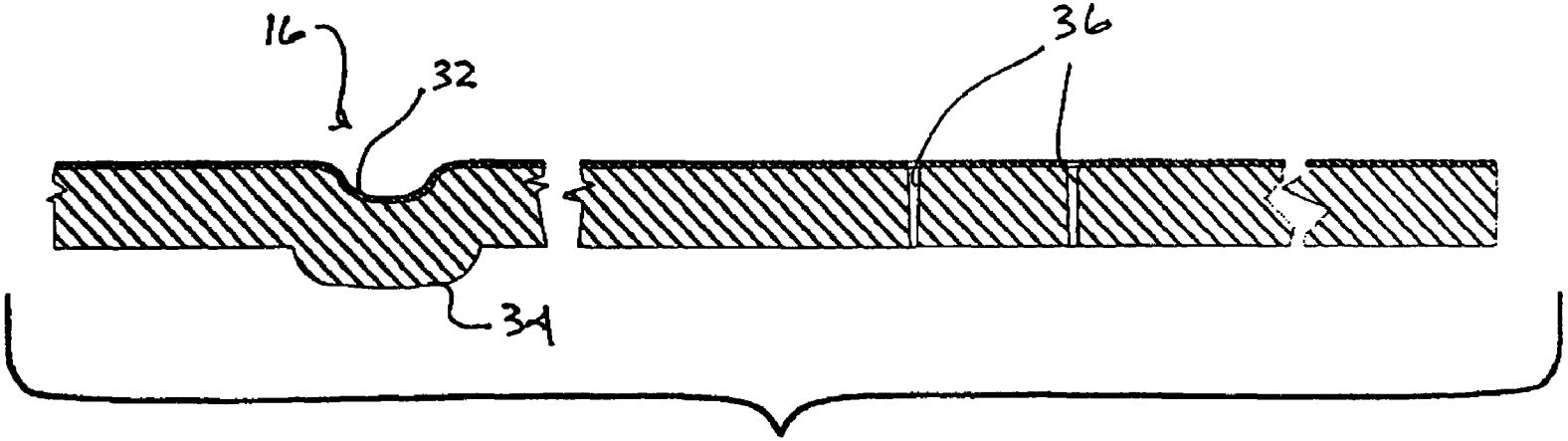
FIG. 4 is an enlarged fragmentary section taken along line 4—4 of FIG. 2.

FIG. 3 is an enlarged fragmentary section taken along line 3—3 of FIG. 2 and FIG. 4 is an enlarged fragmentary section taken along line 4—4 of FIG. 2. The standard score lines 16 and perforated lines 14 are shown in FIG. 4 with score lines defined by a generally semi-cylindrical recess 32 in the top surface of the panel and a corresponding, but slightly larger, generally semi-cylindrical protrusion or rib 34 in the bottom surface.

The perforations 36 defining the perforated lines are shown as holes or apertures that penetrate the blank of material 12. The perforations in the disclosed material are shown as elongated, slot type perforations even though cylindrical perforations or other shapes could be utilized. The slotted perforations define a fold line that is relatively broad with parallel lines of perforations being formed in the blank material at a spacing corresponding to the width of the desired fold.

Figure 5:
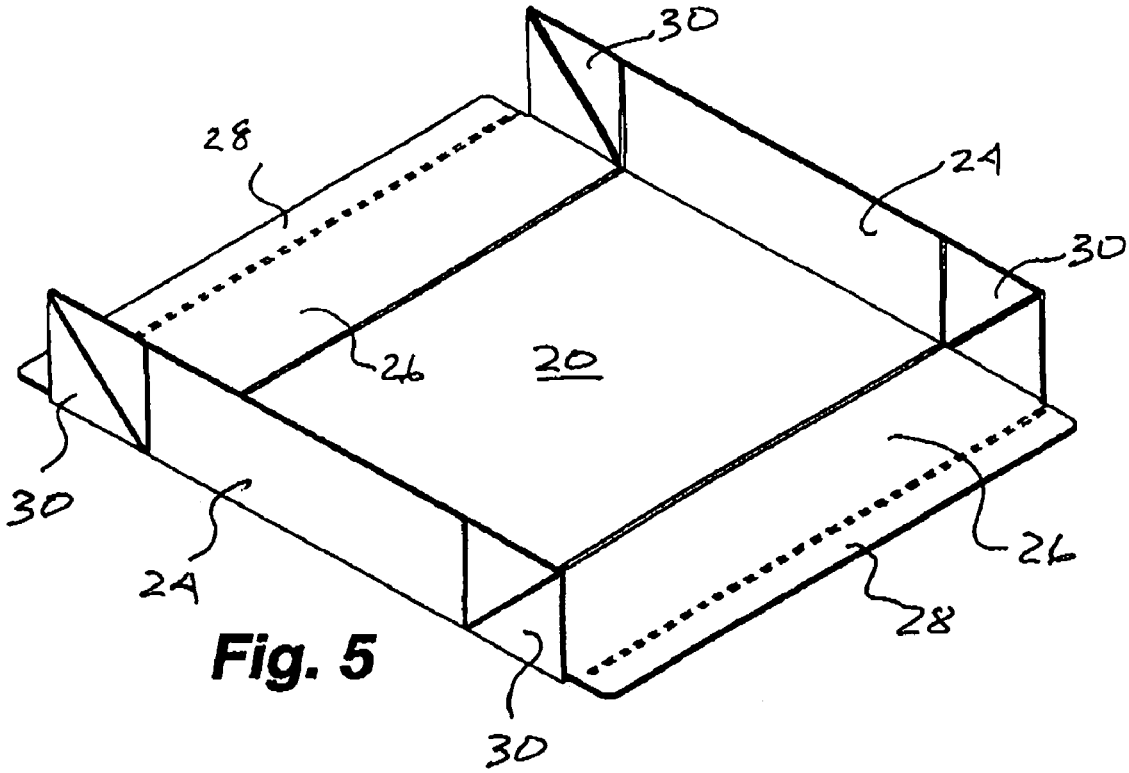
FIG. 5 is an isometric view showing end wall portions of the blank having been folded upwardly.
Figure 6:
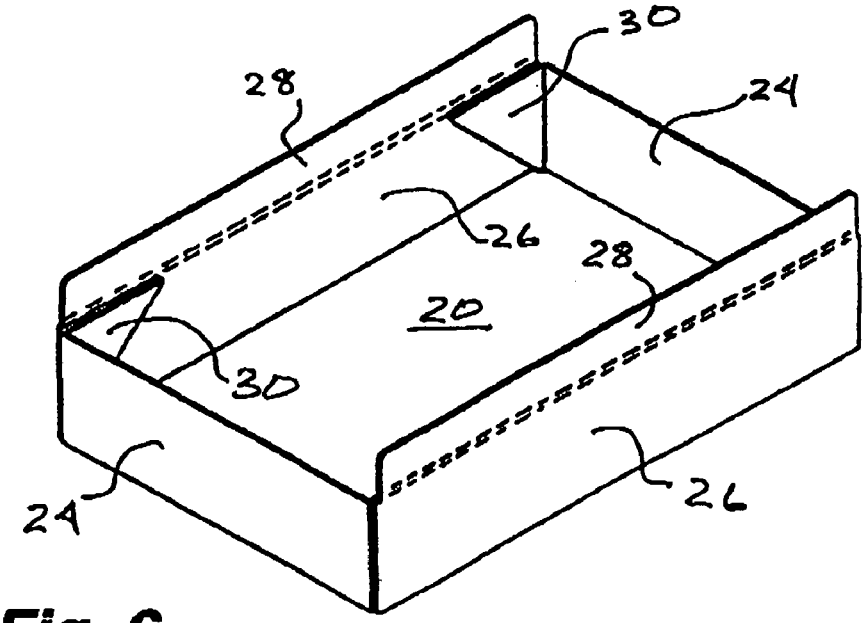
FIG. 6 is an isometric view showing side walls of the blank folded upwardly.
Figure 7:
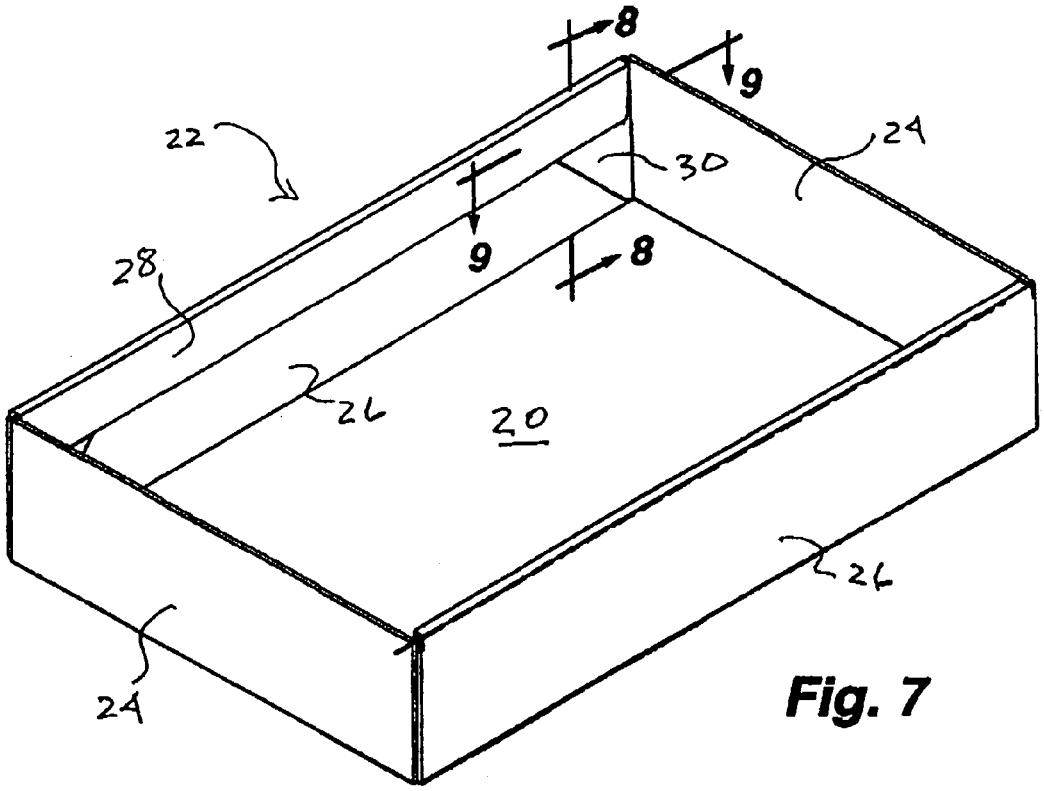
FIG. 7 is an isometric view with the closure tabs on the side walls folded over corner gussets.

FIGS. 5–7 illustrate various stages of forming the open topped container 22 from the blank of material 12 shown in FIGS. 1 and 2, in accordance with the exemplary embodiment of the present invention. The container 22 can also be referred to as a carton, and aspects of the present invention are applicable to a wide range of different types of carton blanks and cartons. In FIG. 5, the end panels 24 with the associated gussets 30 are first folded upwardly to be perpendicular to the bottom panel 20 and the side panels 26. Subsequently, as illustrated in FIG. 6, the side panels 26 are folded upwardly with the gusseted corners 30 simultaneously folding inwardly into a position immediately adjacent the inner surface of the side panels. In FIG. 7, the flaps or tabs 28 along the edges of the side panels are folded inwardly and downwardly over the gusseted corners and are secured in position, such as with an adhesive or the like.

Figure 8:
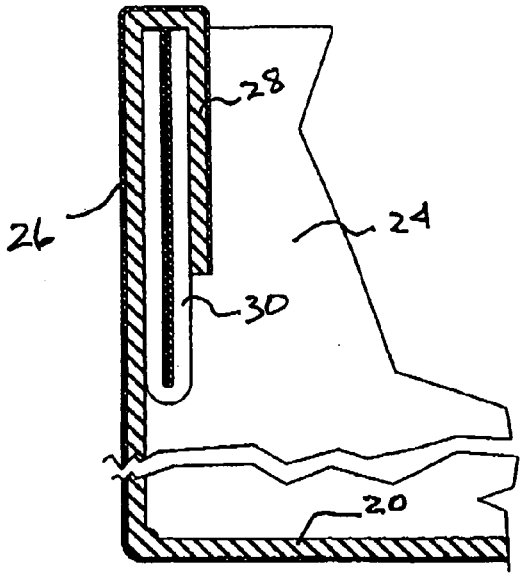
FIG. 8 is an enlarged fragmentary section taken along line 8—8 of FIG. 7.
Figure 9:
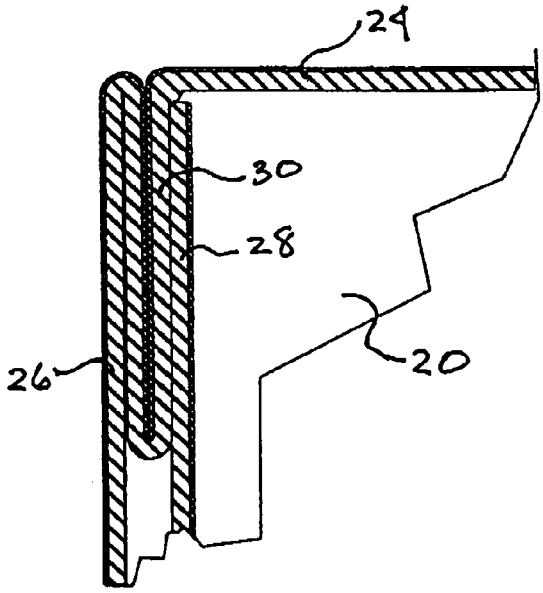
FIG. 9 is an enlarged fragmentary section taken along line 9—9 of FIG. 7.

FIGS. 8 and 9 are vertical and horizontal sections, respectively, taken through a corner of the completed open topped container 22 and illustrating the position of the gusseted corner 30 between the side panel 26 and its associated flap 28. The panel shown can have corners that are sealed and water tight to allow the container to hold beverages and/or ice that might melt, or for other purposes.

As mentioned previously, score lines 18 with reverse kiss cuts fold more readily than reasonably comparable conventional score lines 16 without reverse kiss cuts. Accordingly, when the side panels 26 are folded upwardly, such as shown in FIG. 6, the gusseted corners 30 readily and automatically fold inwardly along the score line 18 with the reverse kiss cut.

Figure 10:
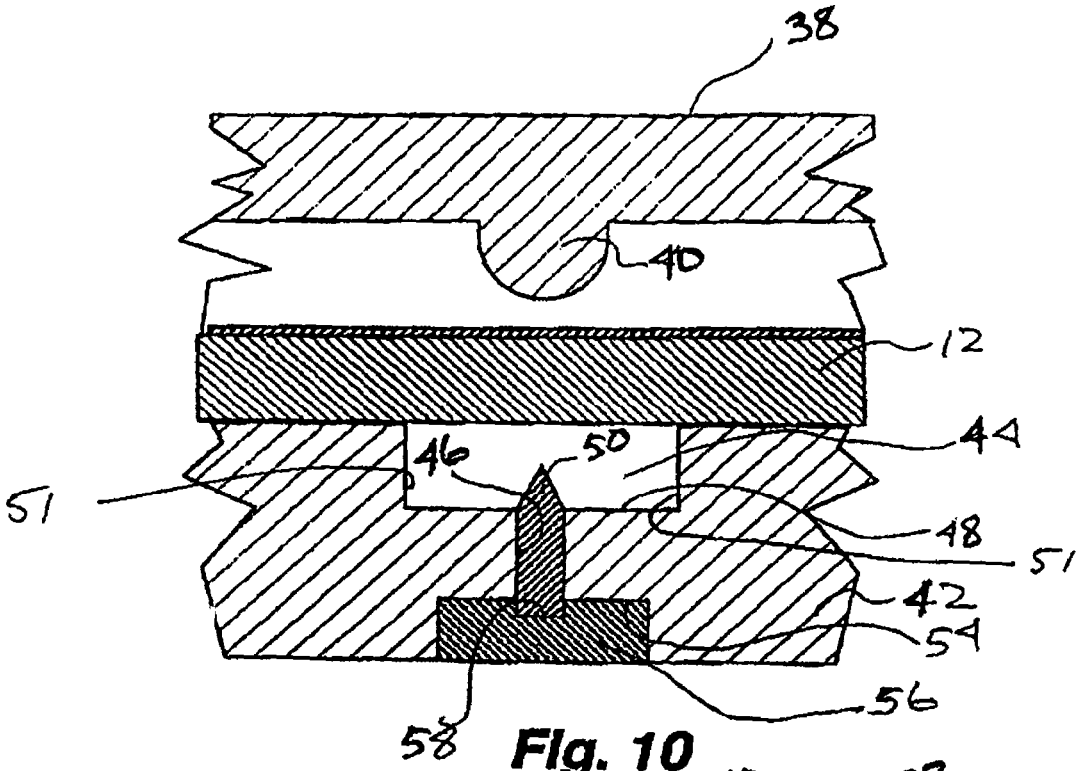
FIG. 10 is a fragmentary vertical section taken through a die set used in a method of the present invention and showing a die plate, a counter plate, and a blank piece of deformable material positioned therebetween.
Figure 11:
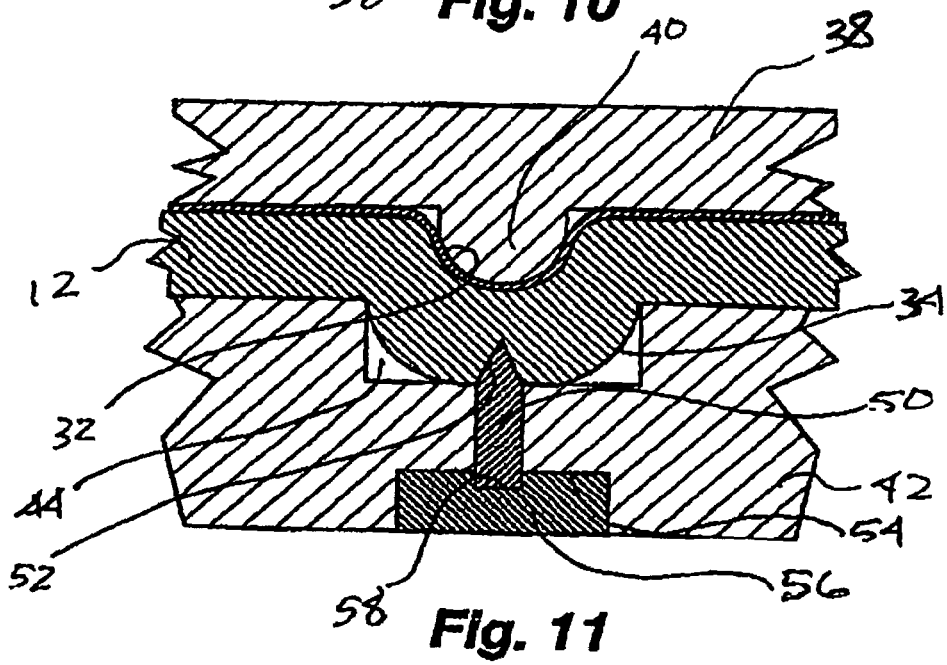
FIG. 11 is a vertical section similar to FIG. 10 with the die plate advanced toward the counter plate to form a score line and a reverse kiss cut in the blank of deformable material.

FIGS. 10 and 11 show a method of forming score lines with reverse kiss cuts in accordance with an exemplary embodiment of the present invention. In FIG. 10, a die plate 38 is illustrated having a longitudinally extending generally semi-cylindrical protrusion 40 along its bottom surface. Differently shaped protrusions 40 are also within the scope of the present invention. The protrusion 40 can be generally referred to as a scoring rule. Opposite the die plate 38 is a another die plate that can be referred to as a counter plate 42. The counter plate has a rectangular channel 44 formed therein that extends parallel to the scoring rule 40 of the die plate 38, and the channel 44 is capable of receiving deformed material from the blank of material 12 when the die plate 38 is advanced toward the counter plate 42 with the blank 12 positioned therebetween, or the like. The channel 44 can be shapes other than rectangular. A knife blade 50 is seated in a longitudinally extending slot 46 formed in a bottom wall 48 of the longitudinal recess in the counter plate. The bottom wall 48 can be more generally referred to as a base wall. As illustrated in FIGS. 10 and 11, sidewalls 51 of the channel 44 are spaced apart from one another, extend perpendicularly away from the bottom wall 48, and define an opening in the face of the counter plate 42; and the face of the counter plate is in opposing face-to-face relation with the blank of material 12. As mentioned previously, the channel 44 can be shapes other than rectangular. For example, the sidewalls 51 of the channel 44 are not required to extend perpendicularly from the bottom wall 48. As one specific example, the sidewalls 51 can transition smoothly from the bottom wall 48 without forming a sharp angle, or the like.

The knife blade 50 generally is an elongated, preferably metallic, material having an upstanding sharpened edge that protrudes upwardly into the channel 44 in the counter plate 42. The slot 46 opens at its lower end into an elongated chamber 54 of rectangular transverse cross-section and through which the knife blade 50 can be inserted into the slot 46. The knife blade 50 is held in position with a retainer bar 56 having an elongated groove 58 of rectangular cross-section in its upper surface aligned with the knife blade 50. The lower edge of the knife blade 50 can be seated in, and be positively retained by, the retainer bar 56.

In accordance with the exemplary embodiment of the present invention, the sharpened edge of the knife blade 50 generally protrudes into the channel 44 approximately fifty percent of the thickness of the deformable material. Other distances are also within the scope of the present invention. When the deformable material is compressed into the channel 44 by the scoring rule 49 as illustrated in FIG. 11, the edge of the knife 50 simultaneously cuts and thereby forms a slit in the protrusion 34 from the bottom surface of the deformable material. Of course, the knife blade 50 can be of any configuration and can be held to protrude into the channel 44 in any manner, with the description herein being only an exemplary configuration.

When the die plate 38 is retracted upwardly, the deformed blank of material retains the score line therein. In accordance with the exemplary embodiment, the score line is defined by the longitudinally extending recess 32 in the top surface, with a generally semi-cylindrical configuration, and the corresponding longitudinally extending protrusion 34 along the bottom surface of the material, also with a generally semi-cylindrical cross-sectional configuration. The generally semi-cylindrical protrusion has a slit 52 extending longitudinally therein that protrudes approximately half the thickness of the deformable material, although other depths and shapes of the slit are also within the scope of the present invention.

It should be understood that, in lieu of advancing the die plate toward the counter plate, the counter plate can be advanced toward the die plate or both the die plate and counter plate could be advanced toward each other. In some of the foregoing, reference is made to advancing the die plate toward the counter plate for simplicity of description, although one of ordinary skill in the art will understand that the invention encompasses advancement of the die plate, counter plate, or both to perform the method described above.

Although the present invention has been described with a certain degree of particularity, it is understood that the disclosure has been made by way of example and changes in detail or structure may be made without departing from the spirit of the invention as defined in the appended claims.

The invention claimed is:

1. A method of forming at least one kiss cut and at least one score line in a sheet of deformable material, the method comprising:

substantially simultaneously (a) scoring a first face of the sheet of deformable material, and (b) kiss cutting a second face of the sheet of deformable material along the score line, wherein the scoring of the first face of the sheet of deformable material and the kiss cutting of the second face of the sheet of deformable material respectively include providing a die plate having at least one protrusion for forming the score line in the sheet of deformable material, providing a counter plate having at least one recess for receiving a portion of the sheet of deformable material, the recess having at least one knife edge therein projecting toward the protrusion, positioning the sheet of deformable material between the die plate and the counter plate, and causing relative movement between the die plate and the counter plate such that the protrusion forces a portion of the sheet of deformable material into the recess and into engagement with the knife edge, whereby the scoring of the first face of the sheet of deformable material and the kiss cutting of the second face of the sheet of deformable material along the score line occurs substantially simultaneously.

2. The method of claim 1, wherein:

the recess is elongate and at least partially defined by an elongate base wall and elongate sidewalls, the side walls are spaced apart from one another and at least partially define the recess' opening, the sidewalls extend away from the base wall, the knife edge is elongate and distant from each of the sidewalls and the base wall.

3. The method of claim 1, further comprising separating the die plate and the counter plate from one another, removing the sheet of deformable material from the die plate and the counter plate, and then erecting a the sheet of deformable material into a container.

4. The method of claim 1, wherein the recess is a rectangular channel.

5. The method of claim 4, wherein the knife blade is secured in a center portion at the base of the channel.

6. The method of claim 1, wherein the kiss cut is formed through approximately half the thickness of the sheet of deformable material.

7. The method of claim 1, wherein the protrusion extends longitudinally along the bottom surface of the die plate.

8. The method of claim 1, wherein the sheet of deformable material comprises layers.

9. The method of claim 1, wherein the scoring of the first face of the sheet of deformable material comprises:

scoring the first face of the sheet of deformable material all the way to an edge of the sheet of deformable material, so that the score line extends all the way to the edge of the sheet of deformable material.

10. The method of claim 1, wherein the sheet of deformable material comprises a blank, and the method further comprises erecting the blank into a carton, and wherein the erecting of the blank into the carton comprises folding the blank along the score line.

11. The method of claim 10, wherein the folding of the blank along the score line comprises:

folding the blank 180 degrees along the score line.

12. The method of claim 1, further comprising:

providing faces that are positioned on opposite sides of the recess and extend flatly away from the recess; and supporting portions of the sheet of deformable material flatly upon the faces while the protrusion forces the portion of the sheet of deformable material into the recess and into engagement with the knife edge.

13. A method of forming at least one kiss cut and at least one score line in a sheet of deformable material, the method comprising:

substantially simultaneously (a) scoring a first face of the deformable material, and (b) kiss cutting a second face of the deformable material along the score line, wherein the scoring of the first face of the deformable material and the kiss cutting of the second face of the deformable material respectively include:

providing a die plate having at least one protrusion for forming the score line in the deformable material, providing a counter plate having at least one recess for receiving a portion of the deformable material, the recess having at least one knife edge therein projecting toward the protrusion, positioning the deformable material between the die plate and the counter plate, and causing relative movement between the die plate and the counter plate such that the protrusion forces a portion of the deformable material into the recess and into engagement with the knife edge, whereby the scoring of the first face of the deformable material and the kiss cutting of the second face of the deformable material along the score line occurs substantially simultaneously, and wherein the kiss cut and score line are formed in a corner gusset of the deformable material.

14. The method of claim 13, wherein the scoring of the first face of the sheet of deformable material comprises:

scoring the first face of the sheet of deformable material all the way to an edge of the corner gusset, so that the score line extends all the way to the edge of the corner gusset.

15. The method of claim 13, wherein the sheet of deformable material comprises a blank, and the method further comprises erecting the blank into the carton, and wherein the erecting of the blank into the carton comprises folding the corner gusset along the score line.

16. A method of forming at least one kiss cut and at least one score line in a sheet of deformable material, the method comprising:

substantially simultaneously (a) scoring a first face of the deformable material, and (b) kiss cutting a second face of the deformable material along the score line, wherein the scoring of the first face of the deformable material and the kiss cutting of the second face of the deformable material respectively include:

providing a die plate having at least one semi-cylindrical protrusion for forming the score line in the deformable material, providing a counter plate having at least one recess for receiving a portion of the deformable material, the recess having at least one knife edge therein projecting toward the semi-cylindrical protrusion, positioning the deformable material between the die plate and the counter plate, and causing relative movement between the die plate and the counter plate such that the semi-cylindrical protrusion forces a portion of the deformable material into the recess and into engagement with the knife edge, whereby the scoring of the first face of the deformable material and the kiss cutting of the second face of the deformable material along the score line occurs substantially simultaneously.

17. The method of claim 16, wherein the scoring of the first face of the sheet of deformable material comprises:

scoring the first face of the sheet of deformable material all the way to an edge of the sheet of deformable material, so that the score line extends all the way to the edge of the sheet of deformable material.

18. The method of claim 16, wherein the sheet of deformable material comprises a blank, and the method further comprises erecting the blank into the carton, and wherein the erecting of the blank into the carton comprises folding the blank along the score line.

19. The method of claim 16, wherein the kiss cut and score line are formed in a corner gusset of the sheet of deformable material.

20. A method of forming at least one kiss cut and at least one score line in a sheet of deformable material, the method comprising:

substantially simultaneously (a) scoring a first face of the sheet of deformable material, and (b) kiss cutting a second face of the sheet of deformable material alone the score line, wherein the kiss cut and score line are formed in a corner gusset of the sheet of deformable material.

21. The method of claim 20, wherein the scoring of the first face of the sheet of deformable material and the kiss cutting of the second face of the sheet of deformable material respectively include:

providing a die plate having at least one protrusion for forming the score line in the sheet of deformable material;

providing a counter plate having at least one recess for receiving a portion of the sheet of deformable material, the recess having at least one knife edge therein projecting toward the protrusion;

positioning the sheet of deformable material between the die plate and the counter plate; and causing relative movement between the die plate and the counter plate such that the protrusion forces a portion of the sheet of deformable material into the recess and into engagement with the knife edge, whereby the scoring of the first face of the sheet of deformable material and the kiss cutting of the second face of the sheet of deformable material along the score line occurs substantially simultaneously.

22. The method of claim 20, further comprising folding the corner gusset along the score line.

23. The method of claim 22, wherein the folding of the corner gusset along the score line comprises:

folding an end panel, which is foldably connected to the gusset, so that the end panel becomes perpendicular to both (a) a bottom panel, which is foldably connected to the end panel, and (b) a side panel, which is foldably connected to the corner gusset.

24. A method of forming a blank that is for being erected into a carton, the forming of the blank comprising:

forming at least one kiss cut and at least one score line in a deformable material, with the forming of the at least one kiss cut and the at least one score line in the deformable material comprising substantially simultaneously (a) scoring a first face of the deformable material, and (b) kiss cutting a second face of the deformable material along the score line, wherein the scoring of the first face of the deformable material and the kiss cutting of the second face of the deformable material respectively include providing at least one recess for receiving a portion of the deformable material, the recess having at least one knife edge therein, forcing a portion of the deformable material into the recess and into engagement with the knife edge, providing faces that are positioned on opposite sides of the recess and extend flatly away from the recess, and supporting portions of the deformable material flatly upon the faces during the forcing of the portion of the deformable material into the recess and into engagement with the knife edge.

25. The method of claim 24, wherein the scoring of the first face of the deformable material comprises:

scoring the first face of the deformable material all the way to an edge of the deformable material, so that the score line extends all the way to the edge of the deformable material.

26. The method of claim 24, further comprising erecting the blank into the carton, wherein the erecting of the blank into the carton comprises:

folding the blank along the score line.

27. A method of forming a blank that is for being erected into a carton, the forming of the blank comprising:

forming at least one kiss cut and at least one score line in a deformable material, with the forming of the at least one kiss cut and the at least one score line in the deformable material comprising substantially simultaneously (a) scoring a first face of the deformable material, and (b) kiss cutting a second face of the deformable material along the score line, wherein the scoring of the first face of the deformable material and the kiss cutting of the second face of the deformable material respectively include providing a die plate having at least one semi-cylindrical protrusion for forming the score line in the deformable material, providing a counter plate having at least one recess for receiving a portion of the deformable material, the recess having at least one knife edge therein, positioning the deformable material between the die plate and the counter plate, and causing relative movement between the die plate and the counter plate such that the semi-cylindrical protrusion forces a portion of the deformable material into the recess and into engagement with the knife edge.

28. A method of forming a blank that is for being erected into a carton, the forming of the blank comprising:

forming at least one kiss cut and at least one score line in a deformable material, with the forming of the at least one kiss cut and the at least one score line in the deformable material comprising substantially simultaneously (a) scoring a first face of the deformable material, and (b) kiss cutting a second face of the deformable material along the score line, wherein the kiss cut and score line are formed in a corner gusset of the deformable material.

29. The method of claim 28, wherein the scoring of the first face of the deformable material and the kiss cutting of the second face of the deformable material respectively include:

providing at least one recess for receiving a portion of the deformable material, the recess having at least one knife edge therein, forcing a portion of the deformable material into the recess and into engagement with the knife edge, providing faces that are positioned on opposite sides of the recess and extend flatly away from the recess, and supporting portions of the deformable material flatly upon the faces during the forcing of the portion of the deformable material into the recess and into engagement with the knife edge.

30. The method of claim 28, further comprising folding the corner gusset along the score line.

* * * * *